US006499175B1

(12) United States Patent
Osiecki et al.

(10) Patent No.: US 6,499,175 B1
(45) Date of Patent: Dec. 31, 2002

(54) COMBINATION SCRUB BRUSH

(76) Inventors: Scott Osiecki, 47 East St., Skaneateles, NY (US) 13152; Steve Sieckowski, 2735 Rolling Hills Rd., Camillus, NY (US) 13031

( * ) Notice: Subject to any disclaimer, the term of this patent is extended or adjusted under 35 U.S.C. 154(b) by 77 days.

(21) Appl. No.: 09/664,208

(22) Filed: Sep. 18, 2000

(51) Int. Cl.[7] ..... A46B 17/08
(52) U.S. Cl. ..... 15/159.1; 15/145
(58) Field of Search ..... 15/159.1, 167.3, 15/145, 176.1, 176.2, 176.6, 144.1, 144.3; 16/110.1, 422, 426, 427, 436; 248/110, 682, 690, 693; D4/130, 132, 138

(56) References Cited

U.S. PATENT DOCUMENTS 263,093 A * 8/1882 Avery
987,981 A * 3/1911 Gross
2,079,367 A * 5/1937 Tringa
2,866,214 A 12/1958 Phillips
2,940,102 A 6/1960 Marinus
3,197,169 A * 7/1965 Burrows
3,369,268 A 2/1968 Burns et al.
3,473,183 A 10/1969 Burns et al.
3,704,480 A * 12/1972 Whitaker
4,000,537 A * 1/1977 Woo
4,194,852 A 3/1980 Cupp et al.
4,215,448 A 8/1980 Burns et al.
4,263,690 A * 4/1981 Dobosi
4,315,342 A 2/1982 Ash
4,489,912 A * 12/1984 Haythornthwaite
4,519,566 A * 5/1985 Manzi
4,777,694 A 10/1988 Young
D324,457 S * 3/1992 Ricciarelli
D356,445 S * 3/1995 Hoagland
5,551,115 A 9/1996 Newville
D389,652 S * 1/1998 Berti
5,778,479 A * 7/1998 Raia
5,857,241 A * 1/1999 Camp et al.
6,006,393 A 12/1999 Lynch et al.
6,151,747 A * 11/2000 Newman et al.
D436,448 S 1/2001 Osiecki et al. ..... D4/129
6,301,740 B1 * 10/2001 Quiroz

* cited by examiner

*Primary Examiner*—Terrence R. Till

(57) ABSTRACT

The present invention is a combination scrub brush, for use with or without a shaft, that presents a finished appearance regardless of whether or not the shaft is in use. The brush includes a grip, a base plate, and a bristle block holding several bristles formed into a substantially flat bristle surface and a curved bristle surface. The base plate is attached lengthwise to the grip, and the grip has a shaft line that is parallel to and offset from the base plate. An internal screw thread in the grip allows the user to attach a shaft to the grip so that otherwise inaccessible surfaces can be cleaned. When the shaft is not in use, a plug inserted into the grip provides a finished appearance to the brush. The plug includes a slot and loop combination used to secure the plug to the grip when the plug is removed and the shaft is installed. The slot and loop combination can also be used to store the entire brush when the shaft is removed and the plug is installed.

19 Claims, 3 Drawing Sheets

COMBINATION SCRUB BRUSH

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates generally to cleaning devices. More specifically, it relates to a scrub brush that always presents a finished appearance and that is adapted for removable attachment to a shaft.

2. Background of the Invention

Combination brushes for use as a hand-held brush and optionally with a shaft are well known in the art. It is also known to provide a cap or plug that allows the brush to present a finished appearance even when the shaft is removed. For example, U.S. Pat. Nos. 3,473,183 and 3,369,268 to Burns et. al. teach hand-held paint tools with gripping portions adapted for reception of an extension pole or cap. The cap closes the gripping portion when the extension pole is not in use, thereby allowing the paint tool to present a finished appearance. However, the Burns patents do not provide a way to secure the cap to the tool when the extension pole is in use. Thus, when the extension pole is attached to the tool the cap must be stored apart from the tool and may easily become lost.

Also, most combination brushes are configured such that extension poles attach crosswise directly to the head of the brush. Therefore, for most brushes, the shaft line or primary axis of extension poles inserted into the brush intersect the brush head and have no offset from the brush head. Even in U.S. Pat. No. 4,215,448, where the handle is offset and parallel to the brush head, an extension pole is attached crosswise to the brush at the brush head and the shaft line intersects the brush head. Although the handle is offset and parallel to the brush head in U.S. Pat. Nos. 3,473,183 and 3,369,268 the extension pole attaches crosswise to brush. In U.S. Pat. No. 5,551,115, an extension pole can attach parallel to and lengthwise to the brush, but the pole is not offset from the handle.

BRIEF SUMMARY OF THE INVENTION

It is in view of the above problems that the present invention was developed. The invention is a combination brush, adapted for use with a shaft or hand-held without a shaft, including a plug that allows the brush to present a finished appearance when the shaft is not in use and means for securing the plug to the brush when the shaft is in use. The brush has a hollow grip, a base plate, and a bristle block holding several bristles with frayed ends that form a substantially flat bristle surface and a curved bristle surface. The base plate is attached lengthwise to the grip, and the shaft line is parallel to and offset from the base plate.

In the preferred embodiment of the invention, the grip and base plate are integrally formed, and the grip is contoured to fit comfortably into the user's hand. A plug is provided at one end of the grip, removably attached thereto by an external screw thread on the plug and an internal screw thread on the grip. When inserted, the plug gives the brush a finished appearance. The plug also has a slot and loop combination that can be used to secure the plug to the grip when it is not inserted (that is, when the shaft is in use). The slot and loop combination can also be used to store the entire brush, for example by hanging it on a hook, when the plug is inserted. When the plug is removed, the internal screw threads on the grip can accept an externally threaded shaft.

It is an object of the present invention to provide a scrub brush that can be hand-held or optionally attached lengthwise to a shaft through an offset and parallel shaft line.

It is another object of the present invention to provide a combination brush that presents a finished appearance at all times, regardless of whether or not the shaft is in use.

It is yet another object of the present invention to provide a combination brush with a cap that includes means for securing the cap to the brush when the cap is not in use.

Further objects and advantages of the present invention will be apparent from the description below with reference to the accompanying drawings in which like numbers indicate like elements.

DETAILED DESCRIPTION OF THE INVENTION

Figure 1:
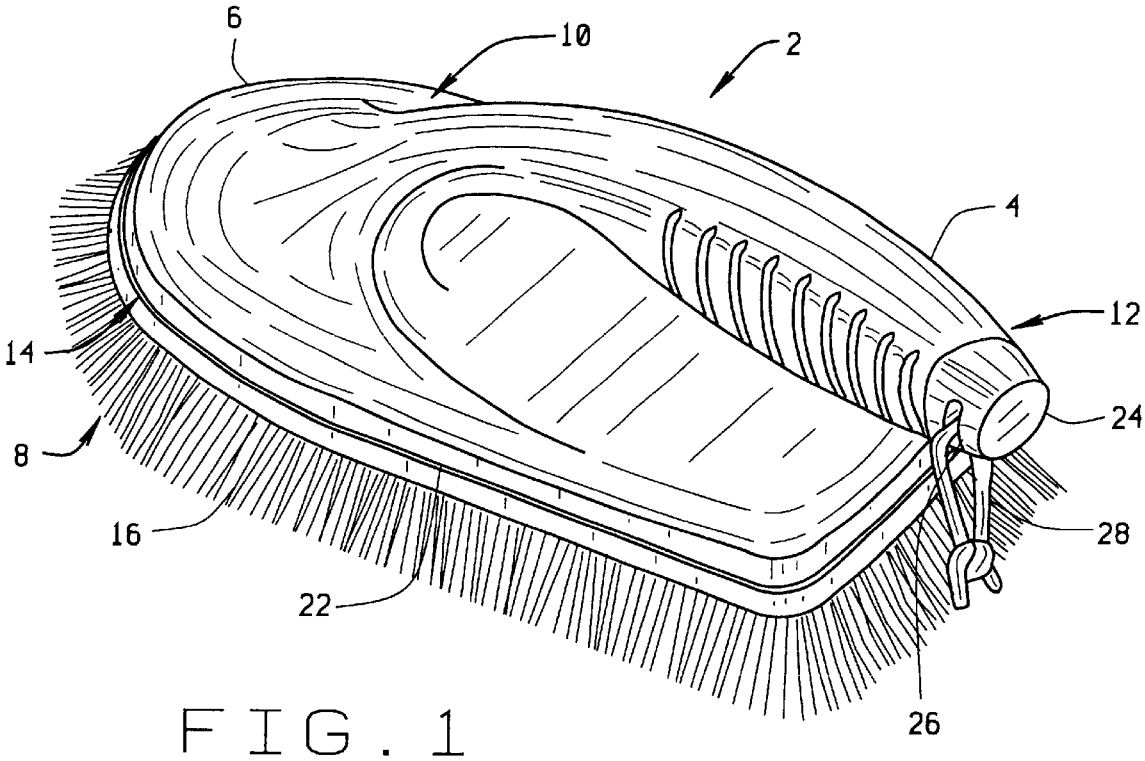
FIG. 1 is a perspective view of the combination scrub brush with the removable plug inserted.

As illustrated by FIGS. 1–6, the combination scrub brush 2 for use with or without a shaft is formed generally by a hollow grip 4, a base plate 6, and a bristle block 8. The grip 4 has a shank end 10 and a free end 12, and base plate 6 is attached to grip 4 at shank end 10.

In the preferred embodiment, base plate 6 is integrally formed with grip 4 through an injection molding process. However, it will be obvious to one skilled in the art that base plate 6 can be attached to grip 4 by any of several well known ways, including gluing, welding, snap-fitting, and the use of hardware such as screws, rivets, and bolts. Grip 4 may be contoured to fit comfortably into one's hand. Bristle block 8 is attached to base plate 6, preferably with several screws, though any of the above-mentioned techniques could be used instead.

Figure 2:
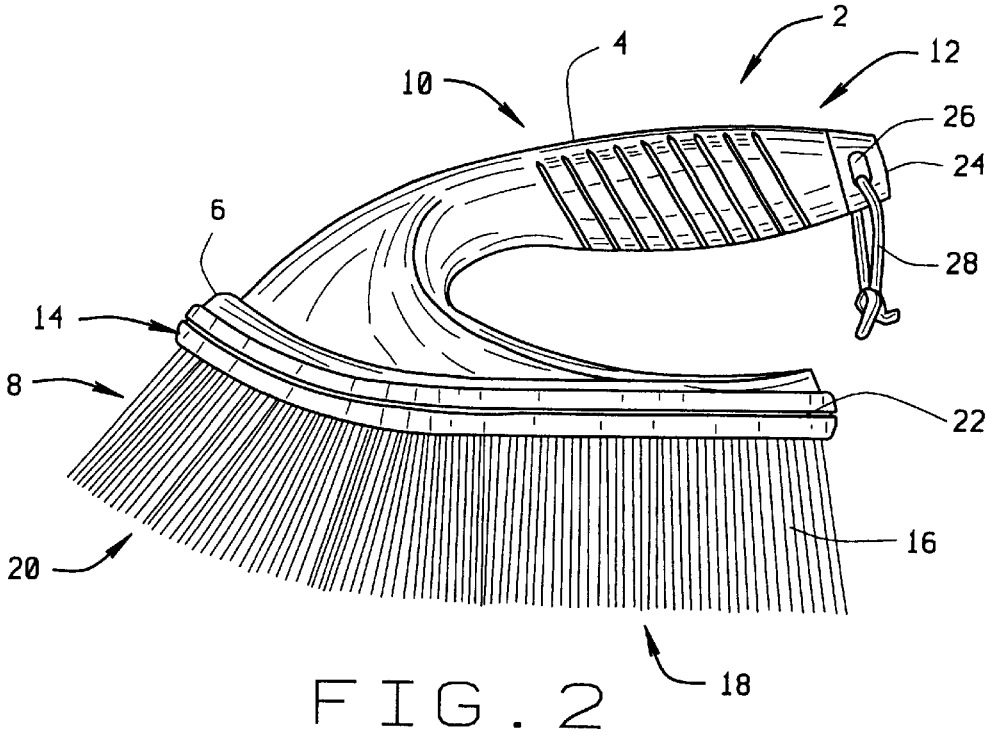
FIG. 2 is a left side view of the combination scrub brush with the removable plug inserted illustrating the substantially flat and curved bristle surfaces.
Figure 3:
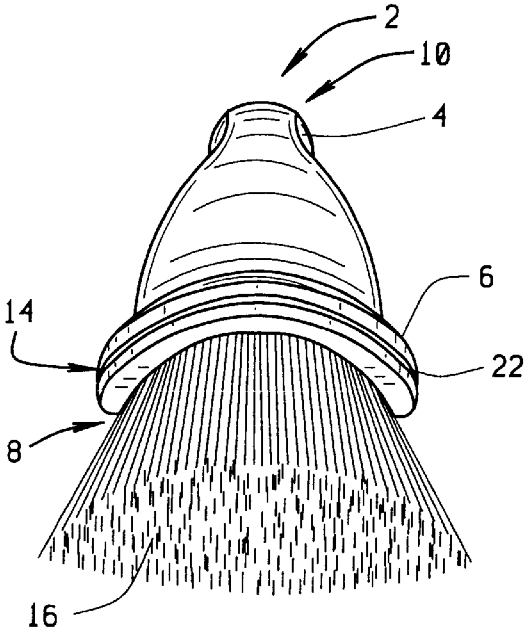
FIG. 3 is a front view of the combination scrub brush.
Figure 4:
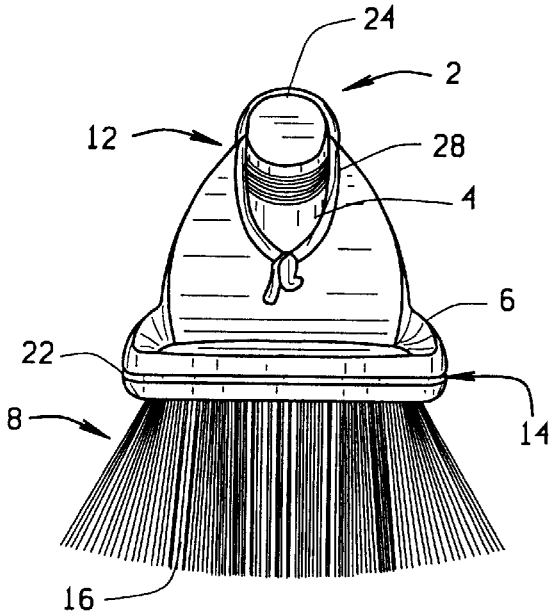
FIG. 4 is a rear view of the combination scrub brush with the removable plug inserted.
Figure 5:
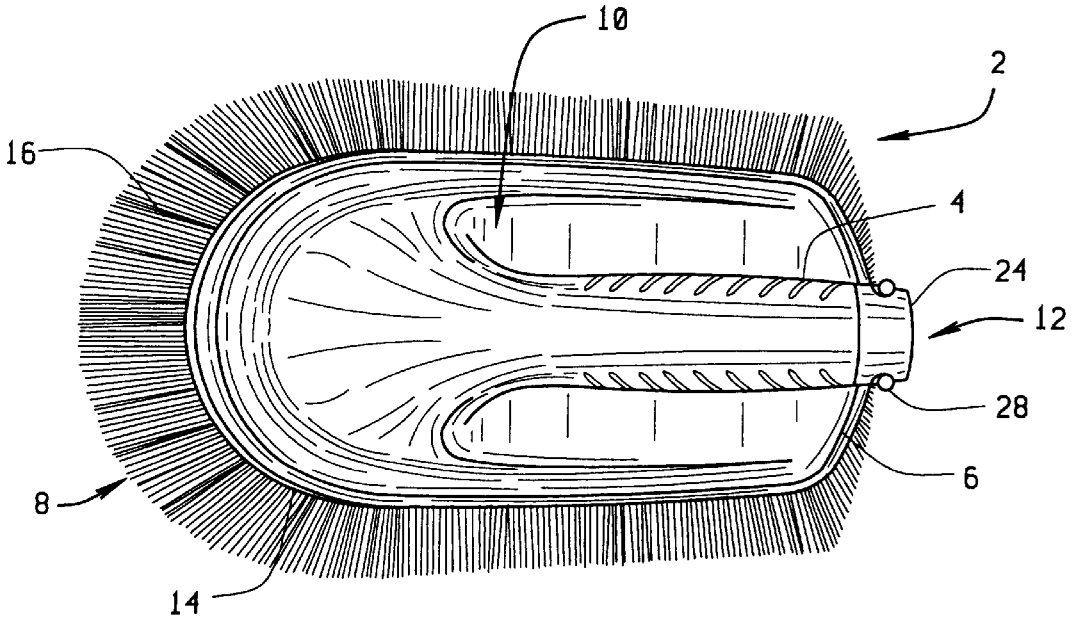
FIG. 5 is a top view of the combination scrub brush with the removable plug inserted.

A block portion 14 of bristle block 8 holds multiple bristles 16. In the preferred embodiment, bristles 16 are arranged in block portion 14 to form a substantially flat bristle surface 18 and a curved bristle surface 20 as best shown in FIGS. 2 and 5. It should be recognized, however, that the invention anticipates that bristles 16 may also be arranged to form a flat bristle surface without any curvature. The ends of bristles 16 are frayed in the preferred embodiment, leading to less abrasive bristle surfaces 18 and 20, thereby reducing the likelihood of scratching the surface to be cleaned. However, the invention anticipates that bristles 16 may be more rigid in embodiments of the present invention designed for heavier duty cleaning or for the cleaning of more durable surfaces. A bumper 22, which may or may not be removable, may also surround block portion 14. Bumper 22 ensures that the hard surface of block portion 14 does not come into contact with the working surface, further reducing the likelihood of scratching the surface to be cleaned.

Figure 6:
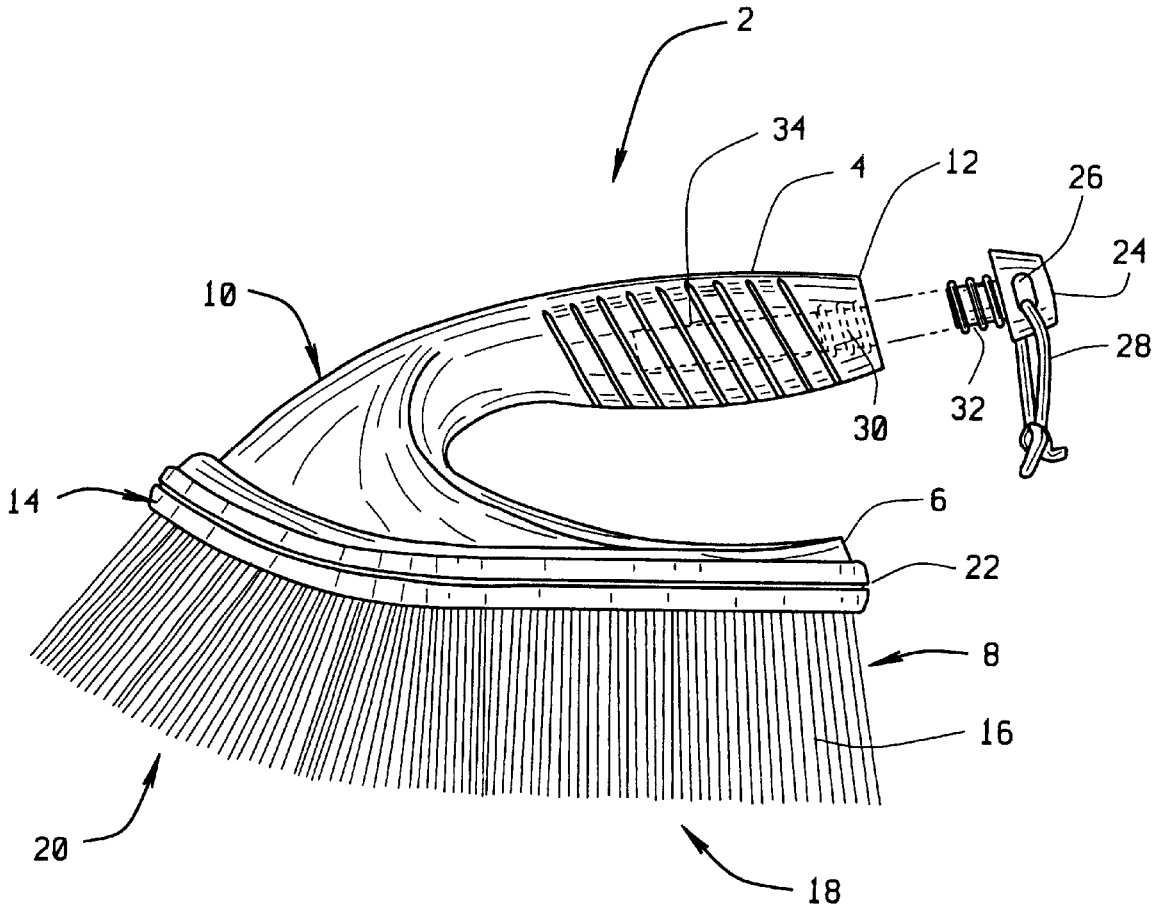
FIG. 6 is a left side exploded view of the combination scrub brush with the removable plug detached.

As shown in FIG. 6, a removable plug 24 is inserted into free end 12 in order to give brush 2 a finished appearance when a shaft is not in use. In the preferred embodiment of brush 2, plug 24 has a slot 26 containing a loop 28 that can be used to secure plug 24 to brush 2 when it is separated from free end 12 by hanging loop 28 on grip 4. Preferably, loop 28 is made from string, wire, or a woven rope. In addition, when plug 24 is inserted into free end 12, loop 28 can be used to store brush 2, for example by hanging the brush on a storage hook in one's garage. Other methods of securing plug 24 to brush 2, such as strapping plug 24 to brush 2 in a manner similar to car gas caps, are also contemplated by the present invention. In the preferred embodiment of the invention, plug 24 is removably secured to grip 4 by way of an internal thread 30 on grip 4 at free end 12 and an external thread 32 on plug 24. However, it will be obvious to one skilled in the art that plug 24 could also be clipped or pinned to grip 4 or even secured by friction.

Brush 2 can also be used for cleaning distant or otherwise difficult to reach surfaces by removing plug 24 and attaching a shaft (not shown) to grip 4. Grip 4 incorporates internal thread 30 at free end 12 that allows one to removably connect an externally threaded shaft to brush 2 when plug 24 is removed. Grip 4 has a shaft line 34 that is offset and substantially parallel to base plate 6. Shaft line 34 runs lengthwise along grip 4, and base plate 6 is attached lengthwise to and offset from shaft line 34 of grip 4 through shank end 10. Brush 2 with an attached shaft extends its reach without the user having to climb, reach, or stretch uncomfortably. For example, brush 2 can be attached to a pole to scrub the roof of a van or sport utility vehicle, a task that would otherwise require the use of a device such as a step stool. Similarly, brush 2 can be attached to a pole in order to clean the vertical and sloped walls of a swimming pool several feet below the waterline.

In view of the foregoing, it will be seen that the several advantages of the invention are achieved and attained. The preferred embodiment and alternatives were chosen and described in order to best explain the principles of the invention and its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A brush comprising:

a grip having a shank end and a free end;

a base plate attached to said shank end of said grip;

a bristle block attached to said base plate;

a plug removably attached to said free end of said grip, said plug having means for securing said plug to said brush when said plug is removed from said free end.

2. The brush according to claim 1, wherein said plug is removably attached to said free end of said grip through an internal screw thread in said free end and an external screw thread on said plug.

3. The brush according to claim 1, wherein said means for securing comprises a slot in said grip and a loop partially disposed in said slot.

4. The brush according to claim 1, further comprising a bumper surrounding said bristle. block.

5. The brush according to claim 4, wherein said bumper is removable.

6. The brush according to claim 1, wherein said bristle block further comprises a block holding a plurality of brush bristles, said brush bristles forming a substantially flat bristle surface and a curved bristle surface.

7. The brush according to claim 6, wherein said brush bristles have frayed ends.

8. The brush according to claim 1, wherein said grip further comprises means for removably attaching a shaft to said grip at said free end when said plug is removed.

9. The brush according to claim 8, wherein said means for removably attaching further comprises an internal screw thread in said free end of said grip.

10. A brush comprising:

a grip having a shank end, a shaft line, and a free end;

a base plate attached to said shank end of said grip and offset from said shaft line of said grip;

a bristle block attached to said base plate;

a bumper surrounding said bristle block;

wherein said bristle block further comprises a block holding a plurality of brush bristles, said brush bristles forming a substantially flat bristle surface and a curved bristle surface.

11. The brush according to claim 10, wherein said brush bristles have frayed ends.

12. The brush according to claim 10, wherein said bumper is removable.

13. The brush according to claim 10, further comprising a plug removably attached to said free end of said grip.

14. A brush comprising:

a grip having a shank end, a shaft line, and a free end;

a base plate attached to said shank end of said grip and offset from said shaft line of said grip;

a bristle block attached to said base plate;

wherein said bristle block further comprises a block holding a plurality of brush bristles, said brush bristles forming a substantially flat bristle surface and a curved bristle surface, and wherein said brush bristles have frayed ends.

15. The brush according to claim 14, further comprising a bumper attached to said bristle block.

16. The brush according to claim 15, wherein said bumper is removable.

17. The brush according to claim 14, further comprising a plug removably attached to said free end of said grip.

18. A brush comprising:

a grip having a shaft line and a free end;

a base plate attached lengthwise to and offset from said shaft line of said grip;

a bristle block attached to said base plate;

a plug removably attached to said free end of said grip; and wherein said shaft line of said grip runs substantially parallel to said base plate.

19. The brush according to claim 18, wherein said plug has means for securing said plug to said brush when said plug is removed from said free end.

* * * * *